US007490673B2

(12) United States Patent
Bartlett

(10) Patent No.: US 7,490,673 B2
(45) Date of Patent: Feb. 17, 2009

(54) UNIVERSAL CONNECTION INTERFACE FOR SUBSEA COMPLETION SYSTEMS

(75) Inventor: Christopher D. Bartlett, Spring, TX (US)

(73) Assignee: FMC Technologies, Inc., Houston, TX (US)

( * ) Notice: Subject to any disclaimer, the term of this patent is extended or adjusted under 35 U.S.C. 154(b) by 295 days.

(21) Appl. No.: 11/245,632

(22) Filed: Oct. 6, 2005

(65) Prior Publication Data

US 2006/0076141 A1 Apr. 13, 2006

Related U.S. Application Data

(60) Provisional application No. 60/616,289, filed on Oct. 6, 2004.

(51) Int. Cl.
*E21B 7/12* (2006.01)

(52) U.S. Cl. ..... 166/368; 166/339; 166/378

(58) Field of Classification Search ..... 166/345, 166/348, 351, 360, 365, 367, 368, 85.1, 77.51, 166/339, 344, 378; 285/18
See application file for complete search history.

(56) References Cited

U.S. PATENT DOCUMENTS 4,478,287 A * 10/1984 Hynes et al. ..... 166/341
4,496,172 A * 1/1985 Walker ..... 285/18
5,113,936 A * 5/1992 Sutherland ..... 166/85.1
5,566,761 A * 10/1996 Pallini et al. ..... 166/345
5,971,077 A * 10/1999 Lilley ..... 166/368
6,039,119 A * 3/2000 Hopper et al. ..... 166/368
6,062,314 A * 5/2000 Nobileau ..... 166/368
6,142,233 A * 11/2000 Wilkins ..... 166/339
6,227,300 B1 * 5/2001 Cunningham et al. ..... 166/339
6,293,343 B1 * 9/2001 Pallini et al. ..... 166/345
6,302,212 B1 * 10/2001 Nobileau ..... 166/368
6,408,947 B1 * 6/2002 Cunningham et al. ..... 166/339
6,470,968 B1 * 10/2002 Turner ..... 166/348
2003/0006041 A1 * 1/2003 Baten et al. ..... 166/368
2003/0178202 A1 * 9/2003 Bartlett et al. ..... 166/368

FOREIGN PATENT DOCUMENTS

GB 2 186 043 A 8/1987

* cited by examiner

*Primary Examiner*—Thomas A Beach
*Assistant Examiner*—Matthew R Buck
(74) *Attorney, Agent, or Firm*—Henry C. Query, Jr.

(57) ABSTRACT

A subsea completion system includes a first component which comprises a first connection interface, a second component which comprises a second connection interface, and a third component which comprises a third connection interface that is complimentary to both the first and second connection interfaces. Consequently, the third component is operatively engageable with either of the first and second components.

14 Claims, 15 Drawing Sheets

UNIVERSAL CONNECTION INTERFACE FOR SUBSEA COMPLETION SYSTEMS

This application is based on U.S. Provisional Patent Application No. 60/616,289, which was filed on Oct. 6, 2004.

BACKGROUND OF THE INVENTION

The present invention relates to completion systems for subsea oil and gas wells. More specifically, the invention relates to a universal interface system for the connections between the various components of the completion system and the tools which are used during installation and testing of the completion system.

Typical subsea completion systems comprise a number of permanently installed components, such as a wellhead, a tubing hanger, a tree, a tree cap, and a flowline jumper. Such systems usually also comprise a number of tools which are used temporarily during installation and testing of the completion system. These tools may include a lower riser package ("LRP"), an emergency disconnect package ("EDP"), a blowout preventor ("BOP"), and a tubing hanger running tool ("THRT"). During installation, testing, and production, these components and tools are stacked atop and connected to each other in a particular configuration.

Typically, the upper end of each of the wellhead, the tree, the EDP and the LRP comprises a hub having a specific external locking profile. In addition, the lower end of each of the tree, the EDP, the LRP, the flowline jumper and the BOP are normally equipped with a hydraulic connector for selectively engaging the external locking profile of another particular component. Furthermore, the upper end of the wellhead may include an internal profile in which the tubing hanger is landed. Moreover, in some systems the tree may include an internal profile which is adapted to receive the tree cap.

During the assembly, testing, and production phases of most common subsea systems, the various components are stacked in a particular order, such that each lower connector portion engages the upper hub portion of another particular component. Since each hub/connector interface can be designed independently, each interface is typically optimized for size, strength, and weight. Thus, the various hubs are often incompatible with all but the one connector they are specifically designed to mate with. The design of the tubing hanger/wellhead interface and the tree/tree cap interface are usually similarly customized. The result of this design philosophy is an inherent inflexibility in the installation and test procedures.

SUMMARY OF THE INVENTION

In accordance with the present invention, these and other limitations in the prior art are addressed with a subsea completion system that includes a first component which comprises a first connection interface, a second component which comprises a second connection interface, and a third component which comprises a third connection interface that is complimentary to both the first and second connection interfaces. Consequently, the third component is operatively engageable with either of the first and second components.

In accordance with one embodiment of the invention, each of the first and second connection interfaces comprises a locking profile and the third connection interface comprises a lock ring that is engageable with the locking profile. In another embodiment of the invention, each of the first and second connection interfaces comprises an external locking profile and the third connection interface comprises an external connector which includes a lock ring that is engageable with the locking profile.

In accordance with another embodiment of the invention each of the first and second connection interfaces comprises a first sealing surface, the third connection interface comprises a second sealing surface, and the first and second sealing surfaces are engageable by a common seal. In another embodiment, each of the first and second connection interfaces comprises a production bore and the third connection interface comprises a production stab which is engageable with the production bore.

The present invention may be utilized in conjunction with a variety of subsea completion systems and installation methods, including those disclosed in U.S. Pat. No. 7,063,157 and U.S. Pat. No. 7,296,629, both of which are hereby incorporated herein by reference.

Thus. the present invention comprises a subsea completion system in which the interfaces between several of the various tools and components have been standardized in a universal configuration. Consequently, these tools and components may be selectively stacked in any desired order and configuration. The invention therefore allows for increased flexibility in the selection of installation and testing procedures, thus providing opportunities for savings in costs and time.

These and other objects and advantages of the present invention will be made apparent from the following detailed description, with reference to the accompanying drawings. In the drawings, the same reference numbers may be used to denote similar components in the various embodiments.

DETAILED DESCRIPTION OF THE PREFERRED EMBODIMENTS

In accordance with the present invention, several components of a subsea completion system, and ideally also the tools which are required to install and test the completion system, are each provided with a universal connection interface on either their upper ends, their lower ends, or both their upper and lower ends. Consequently, the order in which these components are connected and installed can be tailored to the needs of a particular subsea well, and the number of tools which are required to install and test the components can be minimized. Accordingly, the present invention provides a great deal of flexibility and cost savings in the design and installation of subsea completion systems.

In an exemplary embodiment of the invention, at least two components comprise a universal lower connection interface and at least two components comprise a universal upper connection interface which is complementary to the lower connection interface. Accordingly, each of the first two components can be connected to either of the second two components. In another exemplary embodiment of the invention, at least one installation or test tool comprises a universal lower connection interface and at least two components comprise a universal upper connection interface which is complementary to the lower connection interface. As a result, the tool may be used with either or both of these two components. In the context of the present invention, the term complimentary means that the universal connection interfaces are capable of being operatively engaged with each other, such as by being connected and/or sealed to each other.

Figure 1:
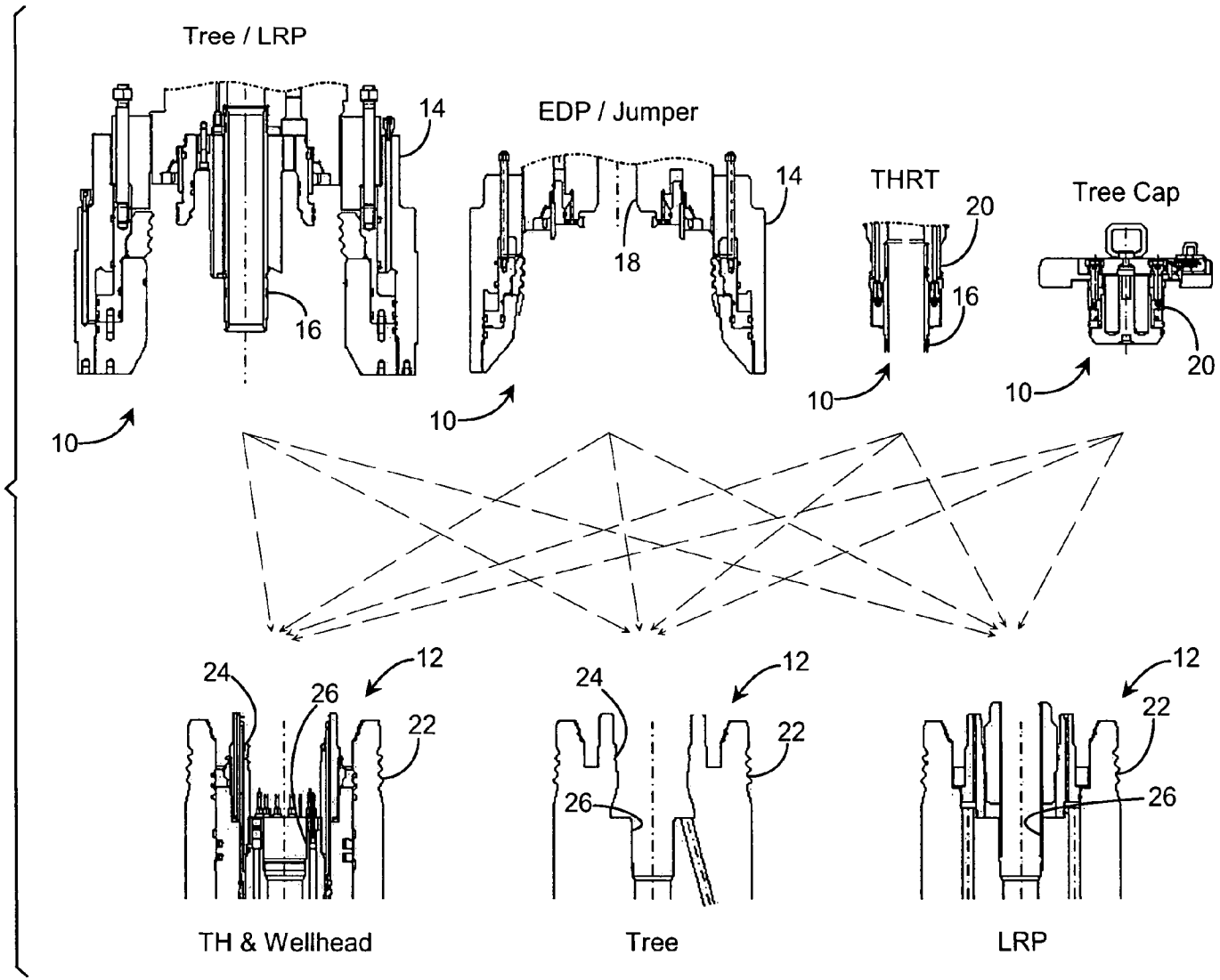
FIG. 1 is a schematic representation of several components of an exemplary subsea completion system which each comprise a universal connection interface of the present invention.

FIG. 1 is illustrative of the flexibility which the universal connection interfaces of the present invention afford in the design and installation of subsea completion systems. The top half of FIG. 1 depicts a number of subsea completion system components which each comprise a universal lower connection interface 10, and the bottom half of FIG. 1 depicts a number of subsea completion system components which each comprise a universal upper connection interface 12. In addition, each of the lower connection interfaces 10 is complementary to each of the upper connection interfaces 12. Thus, each of the components shown in the top half of FIG. 1 can be connected to each of the components shown in the bottom half of FIG. 1. For example, the EDP may be installed on either the wellhead, the tree or the LRP. Similarly, the THRT may be used with either the tubing hanger, the tree or the LRP.

Moreover, several of the components shown in FIG. 1, such as the tree and the LRP, may comprise both a universal lower connection interface 10 and a universal upper connection interface 12. As a result, each such component can be installed in a variety of locations in the subsea completion system.

It should be noted that, in the context of the present invention, the term universal does not necessarily mean identical. Rather, to be considered universal, the connection interfaces should have a minimum number of similar features which will enable them to operatively engage the connection interface of at least one other component. As shown in FIG. 1, for example, the lower connection interfaces 10 for the EDP and the tree cap are not identical; however, these connection interfaces comprise a sufficient number of similar features to enable the EDP and the tree cap to be connected to both the tree and the LRP.

Thus, the universal lower connection interfaces 10 for the components shown in the upper half of FIG. 1 comprise certain similar features which enable each of these component to be connected to any of the components shown in the lower half of FIG. 1. Likewise, the universal upper connection interfaces 12 for the components shown in the lower half of FIG. 1 comprise certain similar features which enable each of these components to be connected to any of the components shown in the upper half of FIG. 1.

In particular, the lower connection interface 10 for each of the tree and the LRP includes an external connector 14 and a production stab 16, the lower connection interface for each of the EDP and the jumper includes an external connector 14 and a production bore 18, the lower connection interface for the THRT includes a production stab 16 and a latching mechanism 20, and the lower connection interface for the tree cap includes a latching mechanism 20. Also, the upper connection interface 12 for each of the wellhead, the tree and the LRP includes an external hub profile 22 which is engageable by the external connector 14, and the upper connection interface for each of the tubing hanger, the tree and the LRP includes both an internal latching profile 24 which is engageable by the latching mechanism 16 and a production bore 26 which sealingly receives the production stab 18.

Thus, the various components shown in FIG. 1 can be connected in a variety of configurations. For example, the tree can be landed and locked onto the wellhead, with the production stab 16 engaging the production bore 26 of the tubing hanger. Also, the LRP can be landed and locked onto either the wellhead or the tree, with the production stab 16 engaging the production bore 26 of either the tubing hanger or the tree. In addition, the EDP and the flowline jumper can each be landed and locked onto the wellhead, the tree, or the LRP. Furthermore, the tree cap can be landed and locked onto either the wellhead, the tree or the LRP. Moreover, the THRT can be used to install not only the tubing hanger, but also the tree and the LRP.

Figure 2:
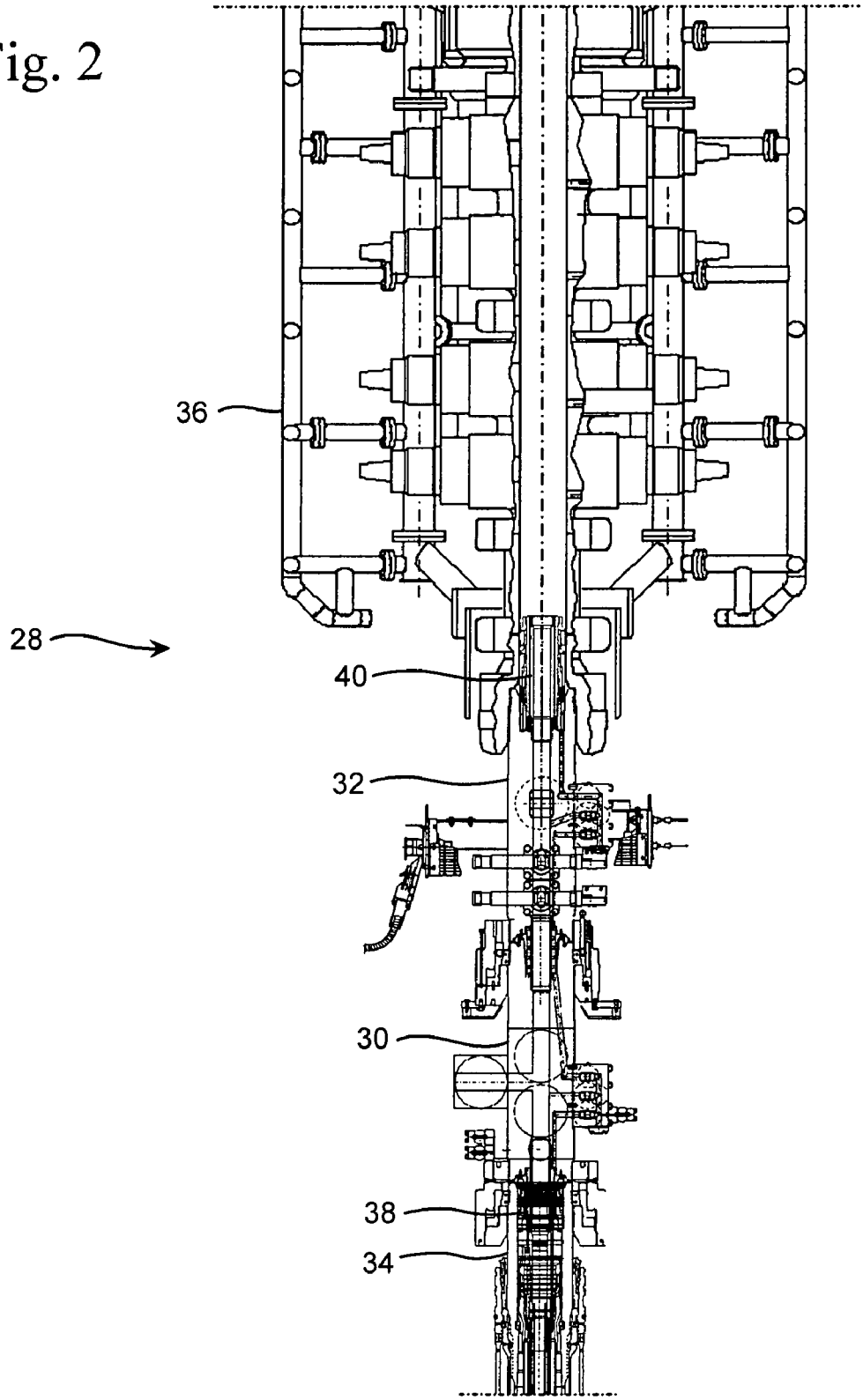
FIG. 2 is a longitudinal cross sectional view of an exemplary embodiment of a subsea completion system having several components which each comprise a universal connection interface of the present invention.

Referring now to FIG. 2, the universal connection interfaces of the present invention may be utilized in the following particularly advantageous installation procedure for an exemplary subsea completion system 28. First, a tree 30 and an LRP 32 are made up at the surface, run subsea on a cable or drill string and then wet parked near a wellhead 34. Alternatively, the tree 30 and the LRP 32 can be made up to a BOP 36 at the surface and this assembly then run subsea, in which event the BOP would be disconnected once the assembly is wet parked near the wellhead 34. Next, the BOP 36 is landed on the wellhead 34, and a tubing hanger 38 is installed in the wellhead through the BOP using a THRT 40. The THRT 40 is then retracted into the BOP 36 and the BOP is disconnected from the wellhead 34 and reconnected to the LRP 32. The BOP/LRP/tree assembly is then landed on the wellhead 34 and the tree 30 is connected to the wellhead. The THRT 40 is then lowered from the BOP 36 and secured to the LRP 32. This is the configuration of the subsea completion system 28 which is shown in FIG. 2.

The flow completion system 28 may now be flow tested. Of particular significance, the LRP 32 provides the necessary barriers for the production bore, and the BOP 36 provides the necessary barriers for the annulus. Thus, no need exists for either a subsea test tree (SSTT) or an open water riser, resulting in significant savings in costs and time.

Figure 3:
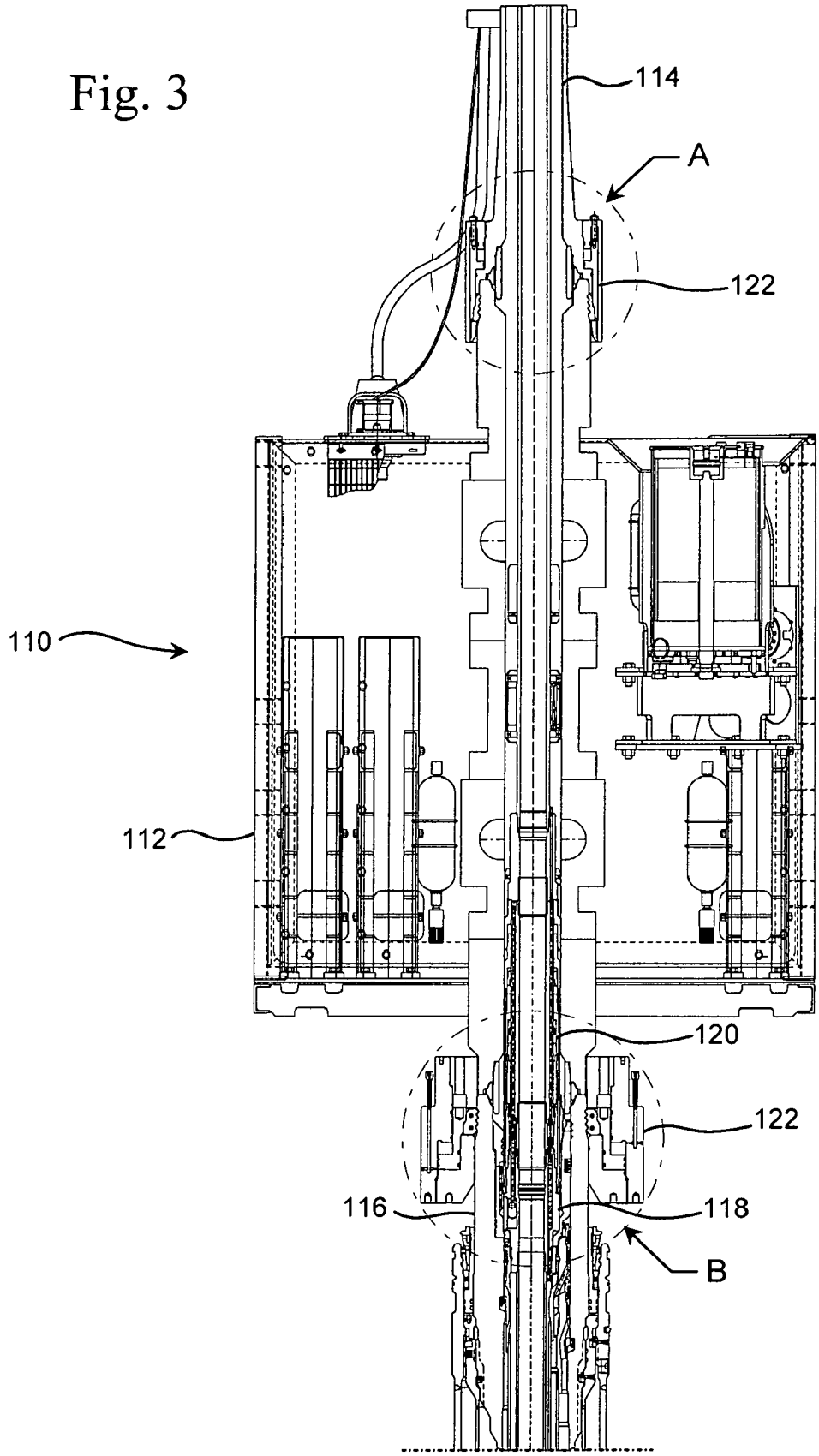
FIG. 3 is a longitudinal cross sectional view of a second exemplary embodiment of a subsea completion system in an initial stage of installation having several components which each comprise a universal connection interface of the present invention.

Turning to FIGS. 3 through 15, the installation sequence for an exemplary flow completion system 110 which comprises universal connection interfaces on several components will now be described. Starting with FIG. 3, a seabed isolation device ("SID") 112, which is similar to a subsea BOP having all but the shear rams removed, is lowered from the surface on a high pressure riser 114 and landed and locked onto a wellhead 116. A tubing hanger 118 is then lowered on a THRT 120 through the high pressure riser 114 and the SID 112 and installed in the wellhead 116.

Figure 4:
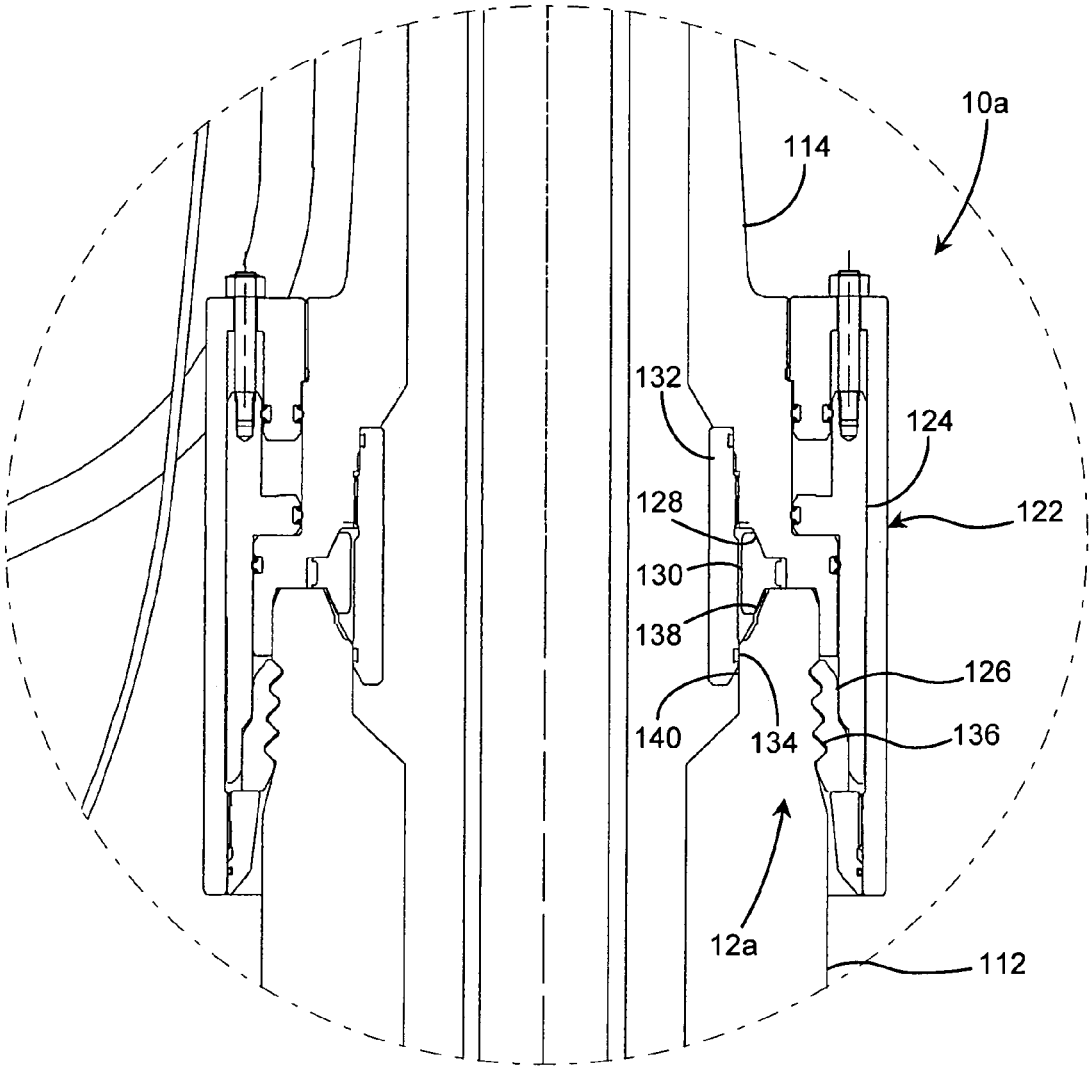
FIG. 4 is an enlarged view of the portion of the completion system of FIG. 3 which is identified by the letter "A"

As shown more clearly in FIG. 4, the high pressure riser 114 comprises a universal lower connection interface 10*a* which is complementary to a universal upper connection interface 12*a* on the SID 112. The lower connection interface 10*a* comprises an external hydraulic connector 122, such as a conventional tieback connector, which includes an actuator 124 and a lock ring 126. The lower connection interface 10*a* also comprises a lower seal groove 128 for a suitable gasket 130, such as a VX gasket, and an isolation adapter bushing 132 which is attached to the high pressure riser 114 and which supports a radially outward facing ring seal 134.

The upper connection interface 12*a* includes an external locking profile 136, such as a conventional H4 hub profile, which is engaged by the lock ring 126 when the connector 122 is actuated to thereby secure the high pressure riser 114 to the SID 112. The upper connection interface 12*a* also comprises an upper seal groove 138 for the gasket 130, which forms a pressure tight seal between the high pressure riser 114 and the SID 112 when these components are secured together, and a sealing surface 140 for the ring seal 134.

Figure 5:
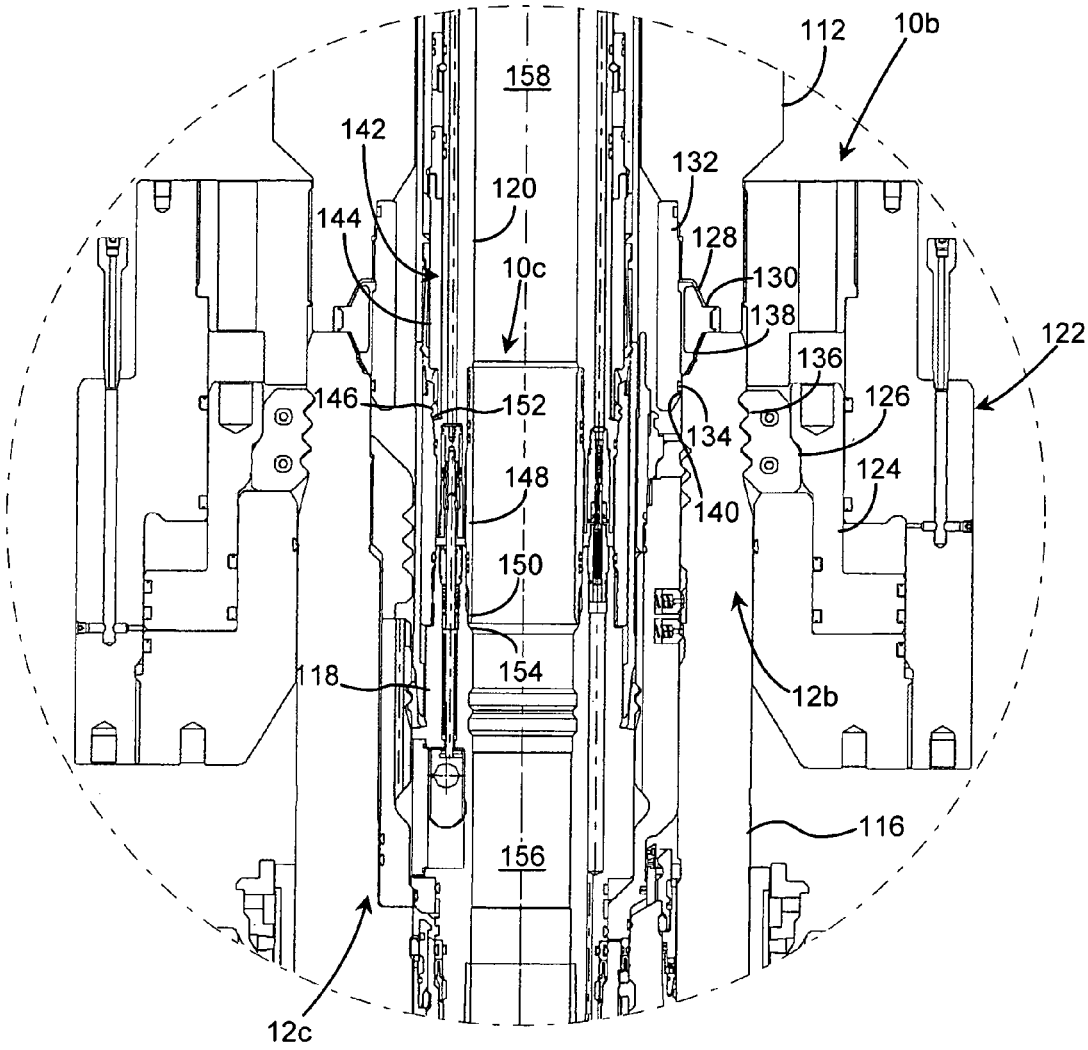
FIG. 5 is an enlarged view of the portion of the completion system of FIG. 3 which is identified by the letter "B"

As shown more clearly in FIG. 5, the SID 112 also comprises a universal lower connection interface 10*b* which is complementary to a universal upper connection interface 12*b* on the wellhead 116. The lower connection interface 10*b* comprises several features which are similar to those of the lower connection interface 10*a*. Thus, the lower connection interface 10*b* comprises an external hydraulic connector 122 which includes an actuator 124 and a lock ring 126, such as the Torus IV connector manufactured by FMC Technologies, Inc. of Houston, Tex. In addition, the lower connection interface 10*b* comprises a lower seal groove 128 for a suitable gasket 130, such as a VX gasket, and an isolation adapter bushing 132 which is attached to the SID 112 and which supports a radially outward facing ring seal 134.

The upper connection interface 12*b* comprises several features which are similar to those of the upper connection interface 12*a*. Thus, the upper connection interface 12*b* includes an external locking profile 136, such as a conventional H4 hub profile, which is engaged by the lock ring 126 when the connector 122 is actuated to thereby secure the SID 112 to the wellhead 116. In addition, the upper connection interface 12*b* comprises an upper seal groove 138 for the gasket 130, which forms a pressure tight seal between the SID 112 and the wellhead 116 when these components are secured together, and a sealing surface 140 for the ring seal 134.

Referring still to FIG. 5, the THRT 120 is shown to comprise a universal lower connection interface 10*c* which is complementary to a universal upper connection interface 12*c* on the tubing hanger 118. The lower connection interface 10*c* comprises an internal latching mechanism 142 which includes an actuator 144 and an internal lock ring 146. In addition, the lower connection interface 10*c* includes a production stab 148 which is secured to the THRT 120 and which includes an annular sealing lip 150 that is formed on its lower end.

The upper connection interface 12*c* comprises an internal locking profile 152 which is engaged by the lock ring 146 when the latching mechanism 142 is actuated to thereby secure the THRT 120 to the tubing hanger 118. The upper connection interface 12*c* also includes a sealing surface 154 which is engaged by the sealing lip 150 to form a pressure tight seal between the tubing hanger production bore 156 and the THRT production bore 158.

Figure 6:
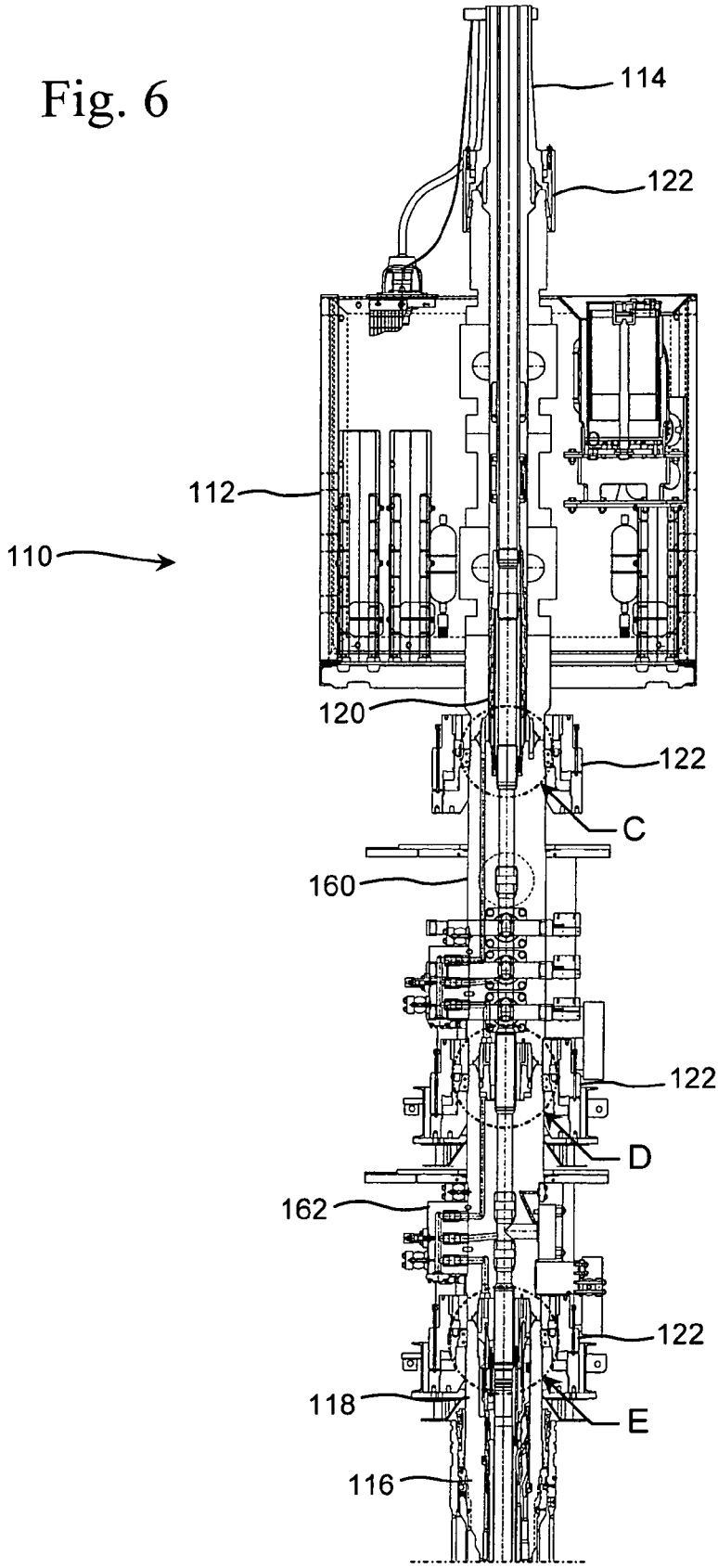
FIG. 6 is a longitudinal cross sectional view of the completion system of FIG. 3 shown in a subsequent stage of installation.

Referring now to FIG. 6, after the tubing hanger 118 is installed in the wellhead 116, the THRT 120 is retracted into the SID 112 and the SID is disconnected from the wellhead. The SID 112 is then connected to an LRP 160 which, as in the previous embodiment, has previously been connected to a tree 162 at the surface and then wet parked next to the wellhead. The SID 112, the LRP 160 and the tree 162 are subsequently lifted as a unit and landed on the wellhead 116, and the tree is then secured to the wellhead.

Figure 7:
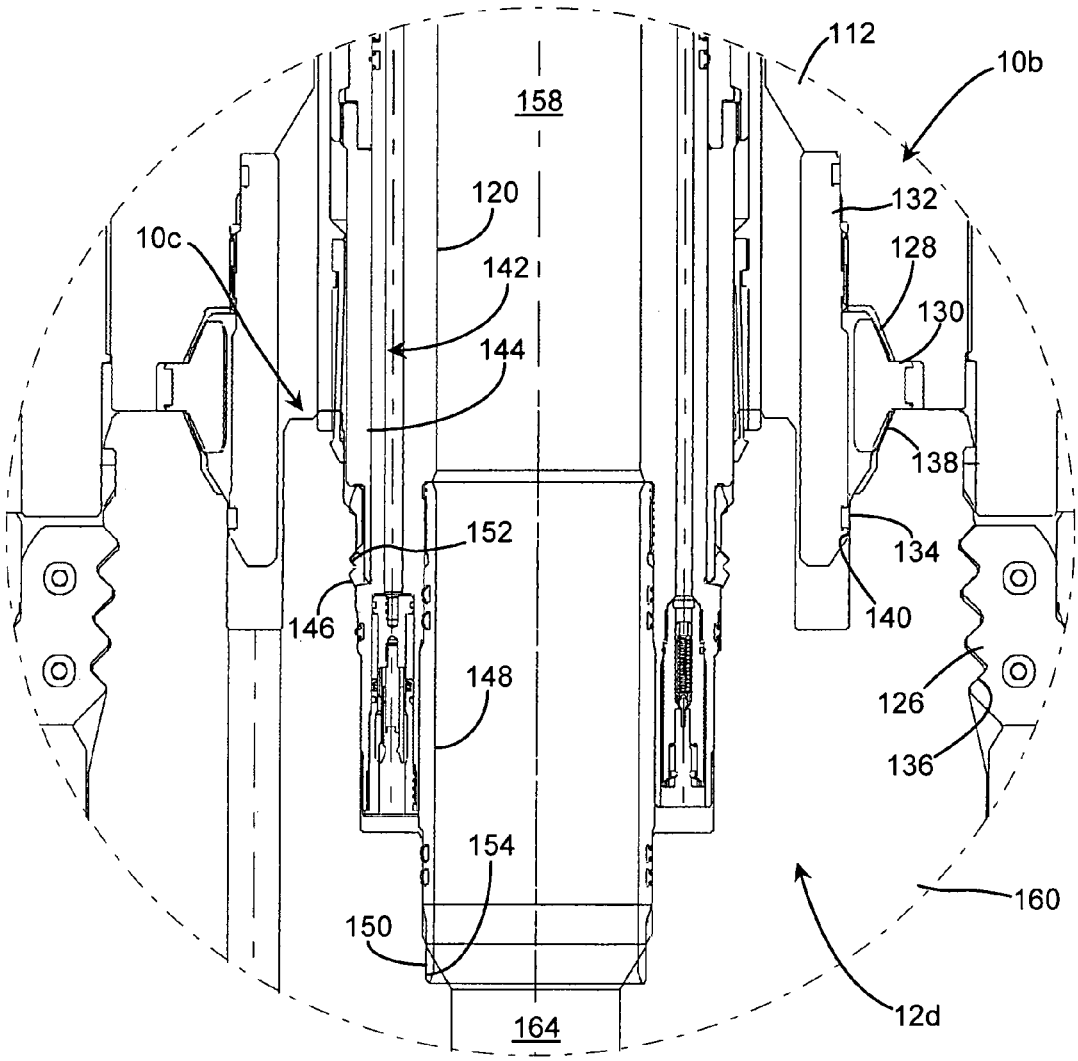
FIG. 7 is an enlarged view of the portion of the completion system of FIG. 6 which is identified by the letter "C"

As shown more clearly in FIG. 7, the LRP 160 comprises a universal upper connection interface 12*d* which is complimentary to the universal lower connection interface 10*b* on the SID 112. The upper connection interface 12*d* comprises several features which are similar to those of the upper connection interfaces 12*a* and 12*b* discussed above. Thus, the upper connection interface 12*d* includes an external locking profile 136, such as a conventional H4 hub profile, which is engaged by the lock ring 126 when the connector 122 is actuated to thereby secure the SID 112 to the LRP 160. The upper connection interface 12*d* also comprises an upper seal groove 138 for the gasket 130, which forms a pressure tight seal between the SID 112 and the LRP 160, and a sealing surface 140 for the ring seal 134.

The universal upper connection interface 12*d* on the LRP 160 is also complimentary to the universal lower connection interface 10*c* on the THRT 120. Thus, the upper connection interface 12*d* comprises several features which are similar to those of the upper connection interface 12*c* for the tubing hanger 118. In this regard, the upper connection interface 12*d* comprises an internal locking profile 152 which is engaged by the lock ring 146 when the latching mechanism 142 is actuated to thereby secure the THRT 120 to the LRP 160. In addition, the upper connection interface 12*d* comprises a sealing surface 154 which is engaged by the sealing lip 150 to form a pressure tight seal between the THRT production bore 158 and the LRP production bore 164.

Figure 8:
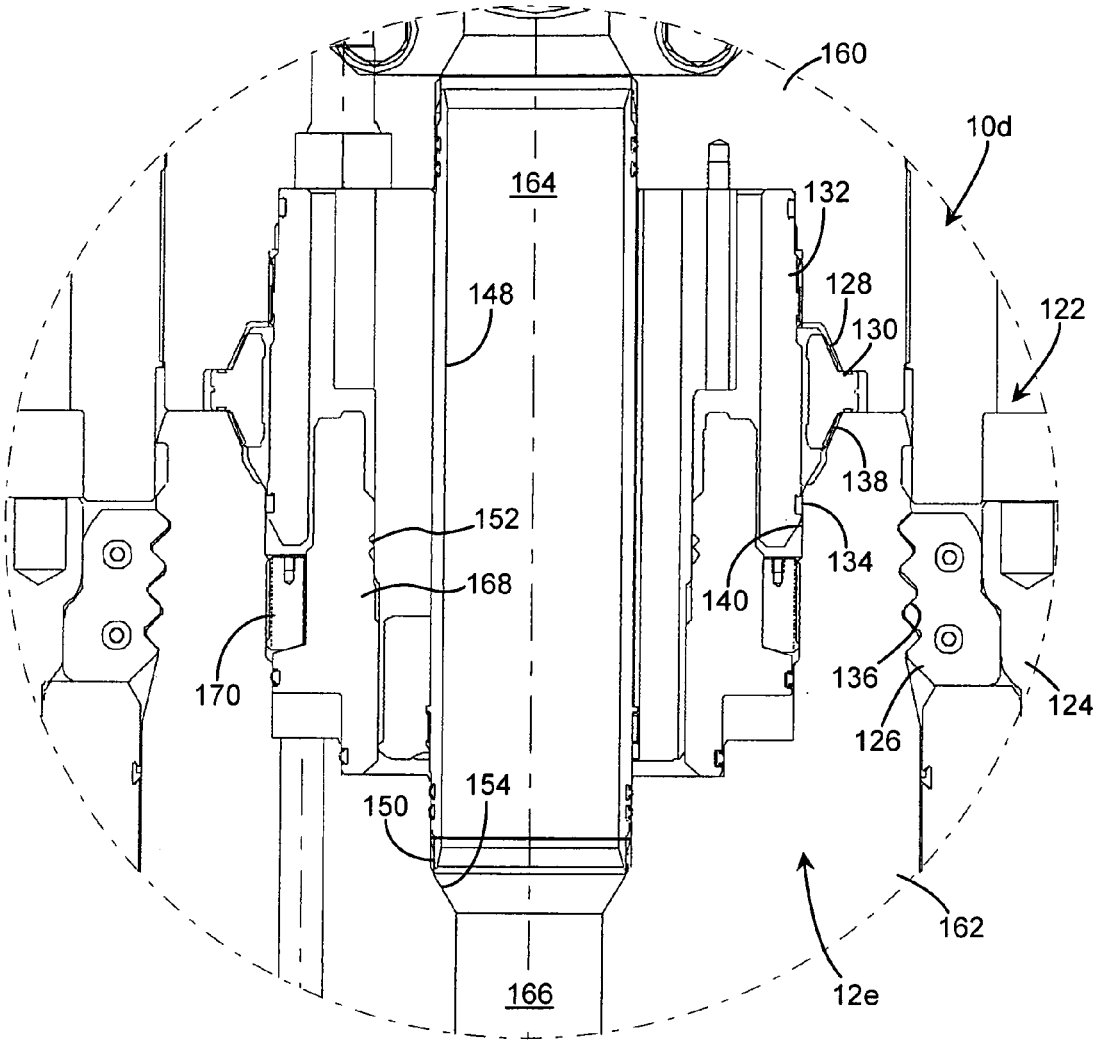
FIG. 8 is an enlarged view of the portion of the completion system of FIG. 6 which is identified by the letter "D"

Referring to FIG. 8, the LRP 160 also comprises a universal lower connection interface 10*d* which is complementary to a universal upper connection interface 12*e* on the tree 162. The lower connection interface 10*d* comprises several features which are similar to those of the lower connection interfaces 10*a*, 10*b* for the high pressure riser 114 and the SID 112. Thus, the lower connection interface 10*d* comprises an external hydraulic connector 122, such as a Torus IV connector, which includes an actuator 124 and a lock ring 126. In addition, the lower connection interface 10*d* comprises a lower seal groove 128 for a suitable gasket 130, such as a VX gasket, and an isolation adapter bushing 132 which supports a radially outward facing ring seal 134. Also, in the embodiment of the invention shown in FIG. 8, the lower connection interface 12*d* comprises a production stab 148 which is secured to the LRP 160 and which includes an annular sealing lip 150 on its lower end.

The upper connection interface 12*e* comprises several features which are similar to those of the upper connection interfaces 12*a* through 12*d* discussed above. Thus, the upper connection interface 12*e* includes an external locking profile 136, such as a conventional H4 hub profile, which is engaged by the lock ring 126 when the connector 122 is actuated to thereby secure the LRP 162 to the tree 162. In addition, the upper connection interface 12*e* comprises an upper seal groove 138 for the gasket 130, which forms a pressure tight seal between the LRP 160 and the tree 162, and a sealing surface 140 for the ring seal 134. Additionally, the upper connection interface 12*d* comprises a sealing surface 154 which is engaged by the sealing lip 150 to form a pressure tight seal between the LRP production bore 164 and the tree production bore 166.

In order to enable THRT 120 to connect to the tree 162, the upper connection interface 12*e* may also include an internal locking profile 152 which is similar to those of the upper connection interfaces 12*c* and 12*d*. In this embodiment, however, the locking profile 152 is formed on a adapter bushing 168 which is secured to the inner diameter of the tree 162 by a lock ring 170. If no need exists to connect the THRT 120 to the tree 162, however, the adapter bushing 168 may be omitted. The adapter bushing 168 thus allows the upper connection interface 12*e* of the tree 162 to be adapted to operatively engage other components of the flow completion system 110, if needed.

Figure 9:
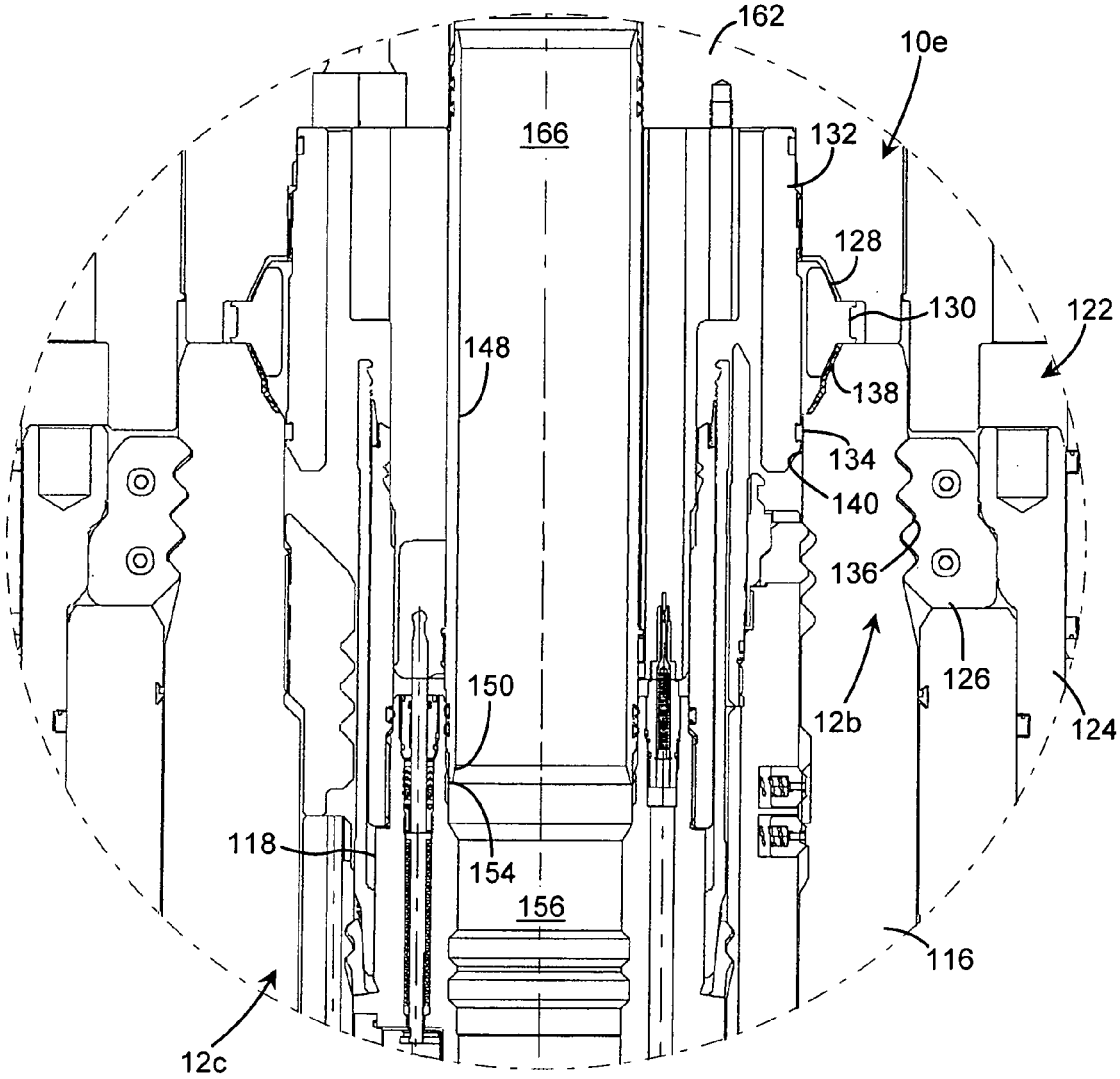
FIG. 9 is an enlarged view of the portion of the completion system of FIG. 6 which is identified by the letter "E"

As shown most clearly in FIG. 9, the tree 162 comprises a universal lower connection interface 10*e* which is complementary to the universal upper connection interfaces 12*b*, 12*c* on the wellhead 116 and the tubing hanger 118, respectively. The lower connection interface 10*e* comprises several features which are similar to those of the lower connection interfaces 10*a* through 10*d* discussed above. Thus, the lower connection interface 10*e* comprises an external hydraulic connector 122 which includes a lock ring 126 that engages the locking profile 136 on the wellhead 116 to thereby secure the tree 160 to the wellhead. In addition, the lower connection interface 10*e* comprises a lower seal groove 128 for the gasket 130 and an isolation adapter bushing 132 which supports a radially outward facing ring seal 134. Furthermore, the lower connection interface 12*e* comprises a production stab 148 which is secured to the tree 162 and which includes an annular sealing lip 150 that sealingly engages the seal surface 154 to thereby provide a fluid tight seal between the tubing hanger production bore 156 and the tree production bore 166.

Figure 10:
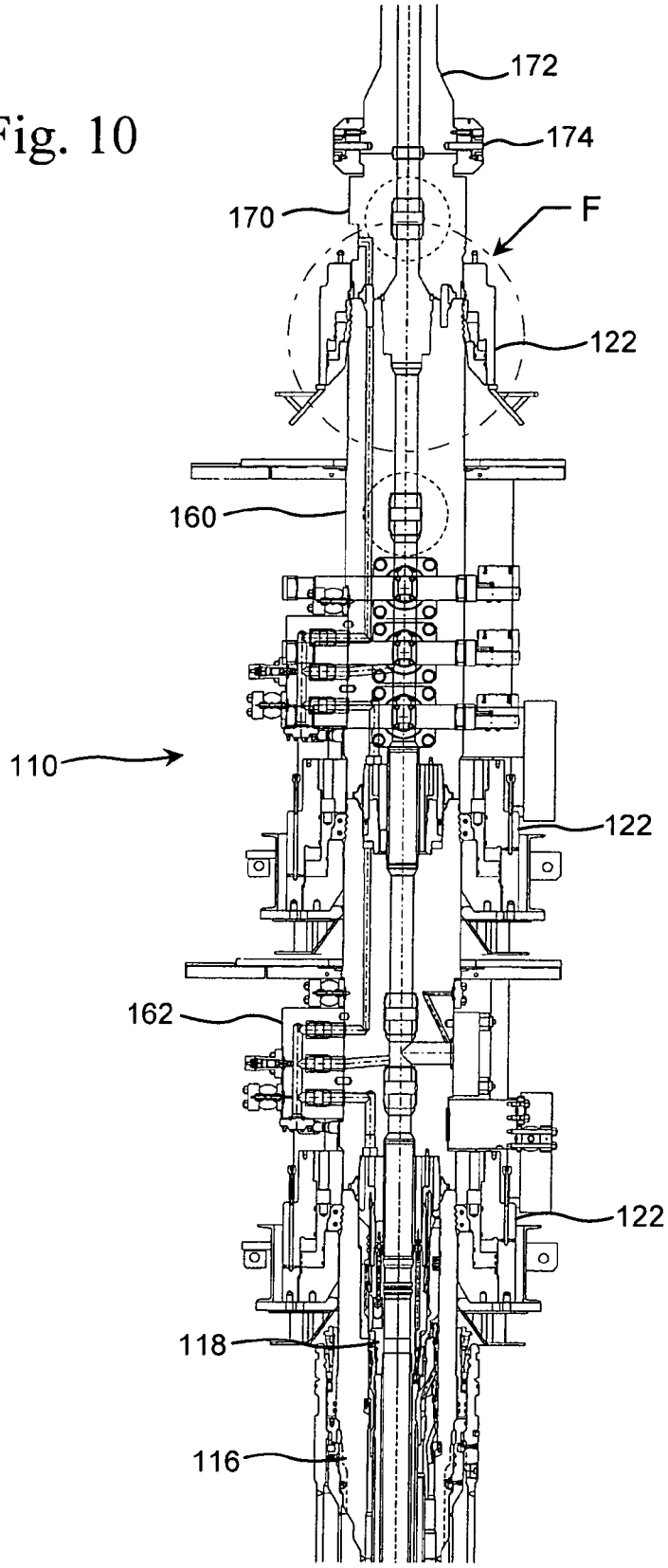
FIG. 10 is a longitudinal cross sectional view of the completion system of FIG. 6 shown in a subsequent stage of installation.

Referring now to FIG. 10, the subsea completion system 110 is shown with the SID 112 and the THRT 120 removed and with an EDP 170 connected to the LRP 160. The EDP 170 is run on an open water riser 172 which is connected to the EDP with, for example, a speed lock clamp 174.

Figure 11:
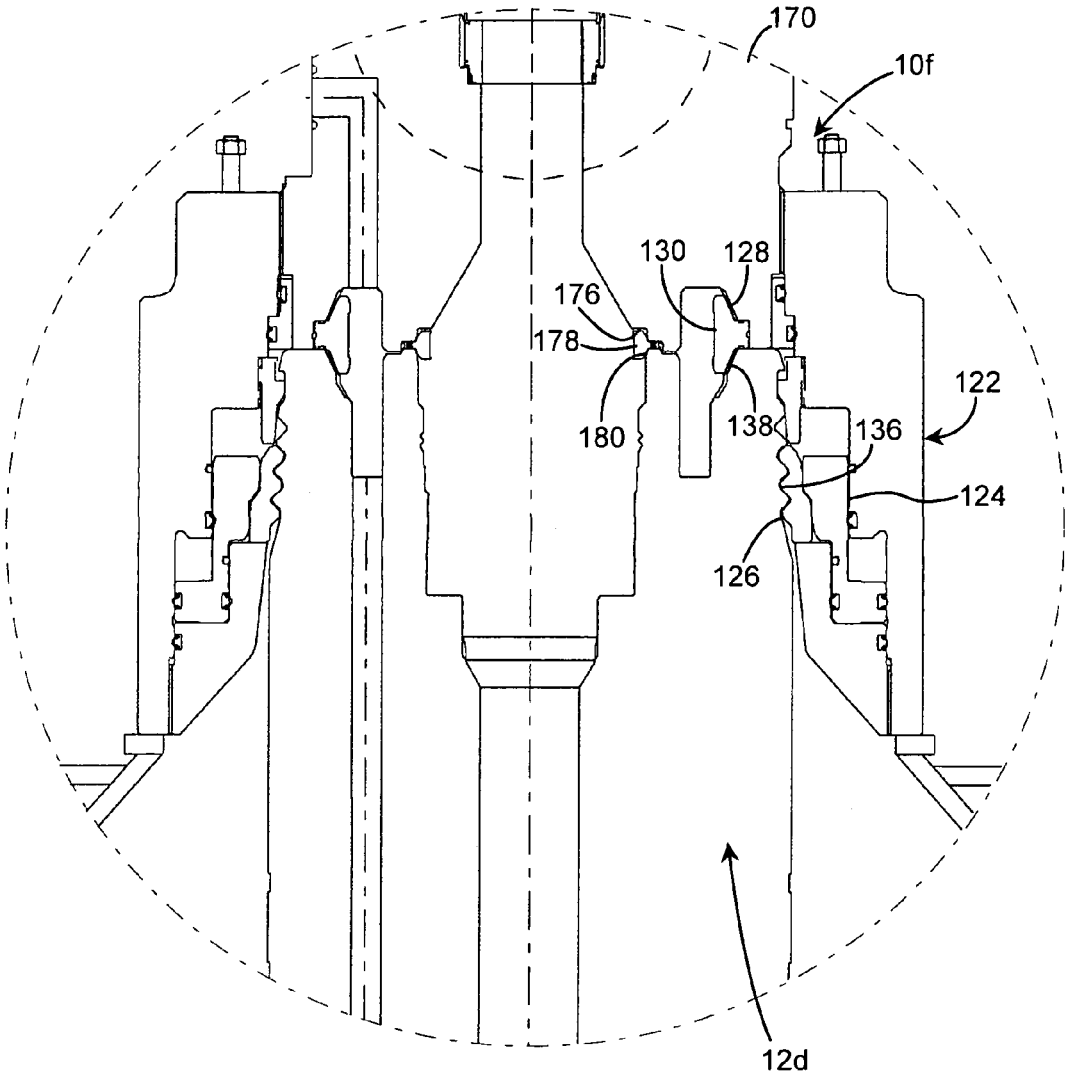
FIG. 11 is an enlarged view of the portion of the completion system of FIG. 10 which is identified by the letter "F"

As shown most clearly in FIG. 11, the EDP 170 comprises a universal lower connection interface 10*f* which is complementary to the universal upper connection interface 12*d* on the LRP 160. Moreover, the lower connection interface 10*f* comprises several features which are similar to those of the lower connection interfaces 10*a* through 10*e* discussed above. Accordingly, the lower connection interface 10*f* comprises an external hydraulic connector 122, such as a high angle release Torus IV connector, which includes a lock ring 126 that engages the locking profile 136 to thereby secure the EDP 170 to the LRP 160. The lower connection interface 10*f* also includes a lower seal groove 128 for the gasket 130, which provides a pressure tight seal between the LRP and the EDP when these two components are secured together. In addition to these features, the lower connection interface 10*f* comprises a lower seal profile 176 for an intermediate gasket 178, which in turn seals against an upper seal profile 180 on the upper connection interface 12*d* for the LRP 160.

Figure 12:
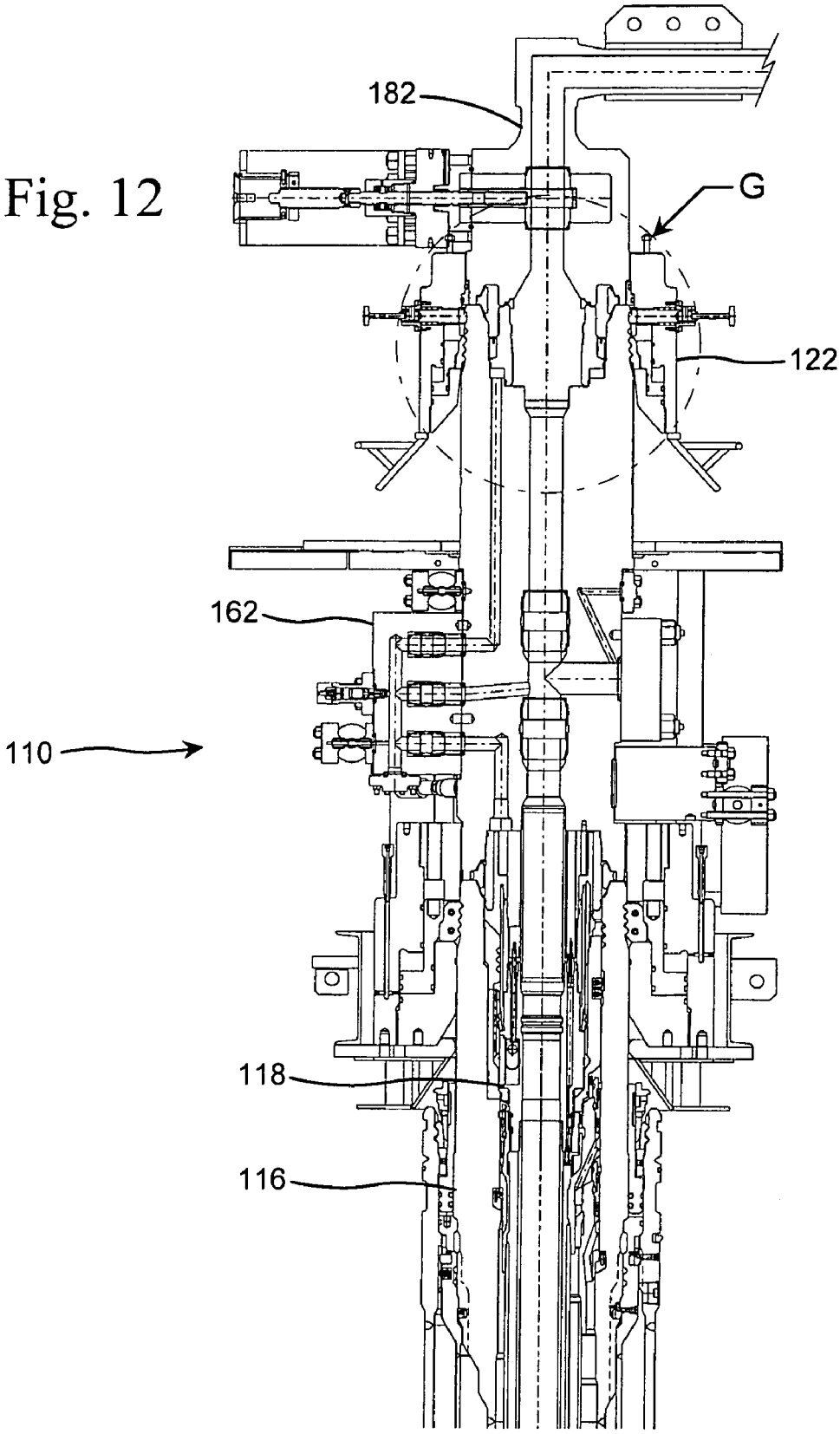
FIG. 12 is a longitudinal cross sectional view of the completion system of FIG. 10 shown in a subsequent stage of installation.

After the flow completion system 110 has been successfully flow tested, it is ready to be placed into production. Referring to FIG. 12, this is accomplished by retrieving the EDP 170 and the LRP 160 and securing, e.g., a subsea centerline jumper 182 to the tree 162.

Figure 13:
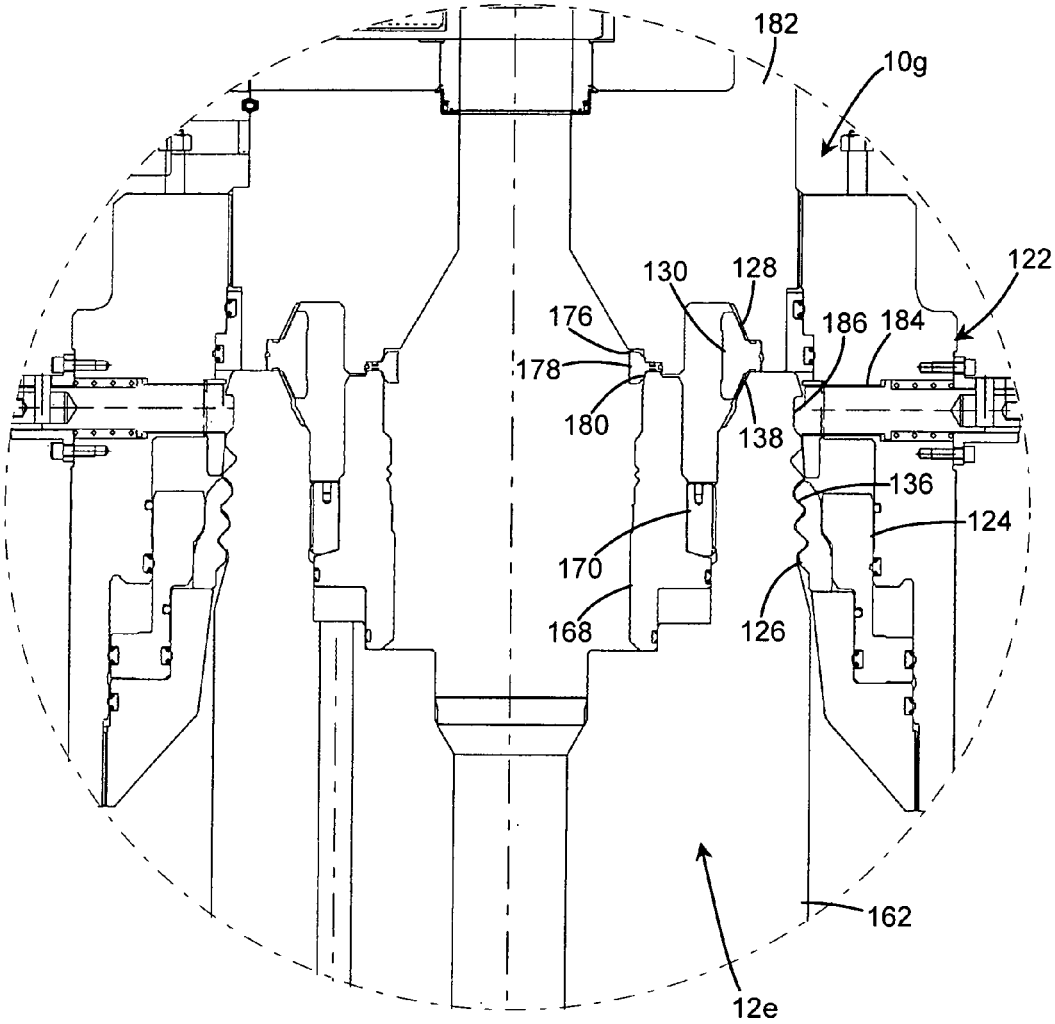
FIG. 13 is an enlarged view of the portion of the completion system of FIG. 12 which is identified by the letter "G"

As shown in FIG. 13, the jumper 182 comprises a universal lower connection interface 10*g* which is complementary to the universal upper connection interface 12*e* of the tree 162. In addition, the lower connection interface 10*g* comprises several features which are similar to those of the lower connection interfaces 10*a* through 10*f* discussed above. Thus, the lower connection interface 10*g* comprises a connector 122 which includes a lock ring 126 that engages the locking profile 136 on the tree 162, a lower seal groove 128 for the gasket 130, and a lower seal profile 176 for the intermediate gasket 178. In contrast to the lower connection interfaces discussed above, however, the lower connection interface 10*g* also includes a number of locking pins 184.

In addition to the features described above, the upper connection interface 12*e* for the tree 162 includes a lock groove 186 which is engaged by the locking pins 184 to further secure the jumper 182 to the tree 162. In addition, the lower sealing profile 180 for the intermediate gasket 178 is formed on the adapter bushing 168, rather than directly on the inner diameter of the tree 162. This characteristic of the present invention allows the upper connection interface 12*e* to be adapted if necessary to operatively engage other components of the flow completion system 110.

Figure 14:
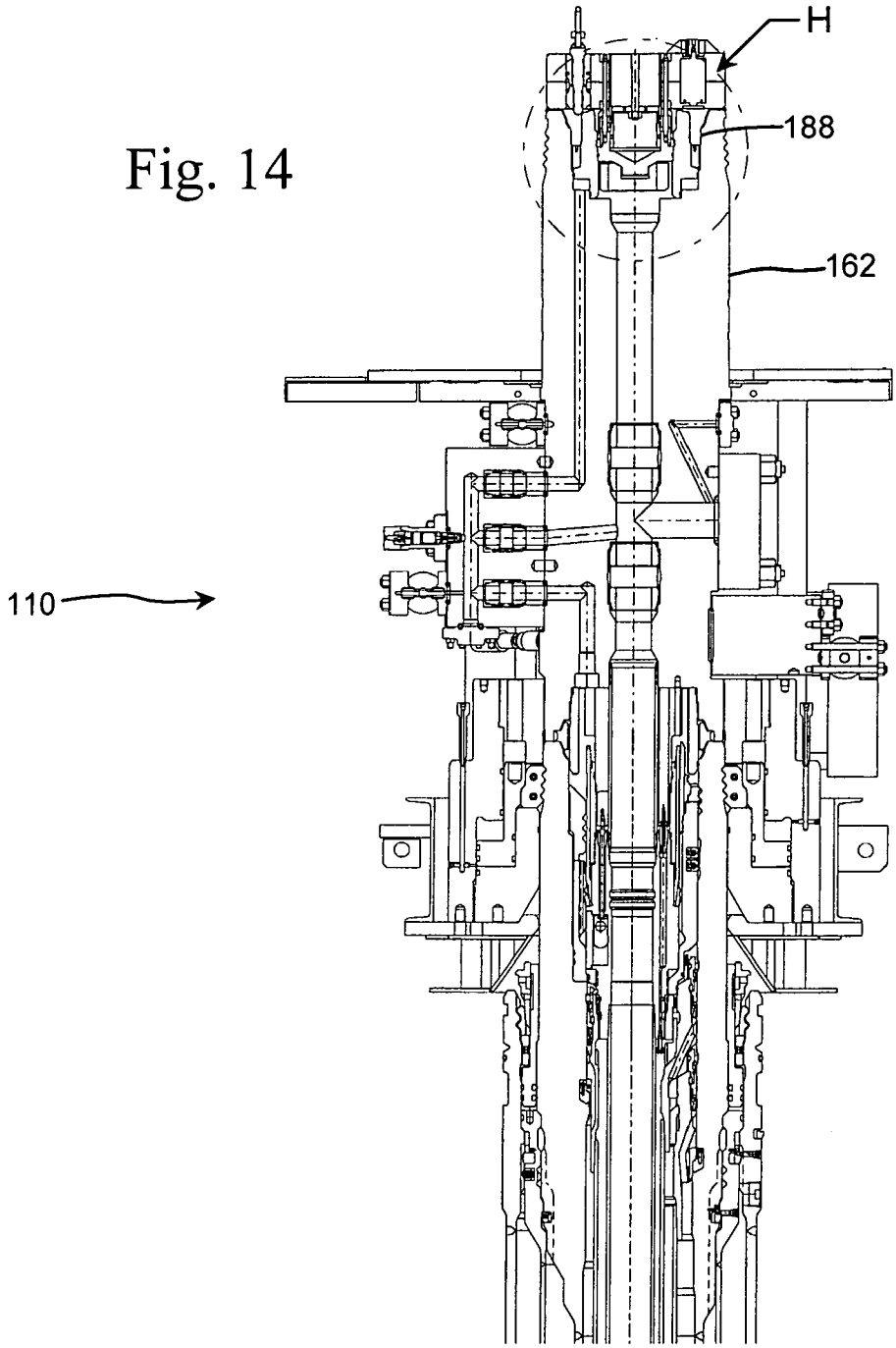
FIG. 14 is a longitudinal cross sectional view of the completion system of FIG. 12 shown in a subsequent stage of installation.

When it is desired to temporarily abandon the well, the subsea centerline jumper 182 can be removed and replaced with a tree cap 188. This is the configuration of the subsea completion system 110 which is shown in FIG. 14.

Figure 15:
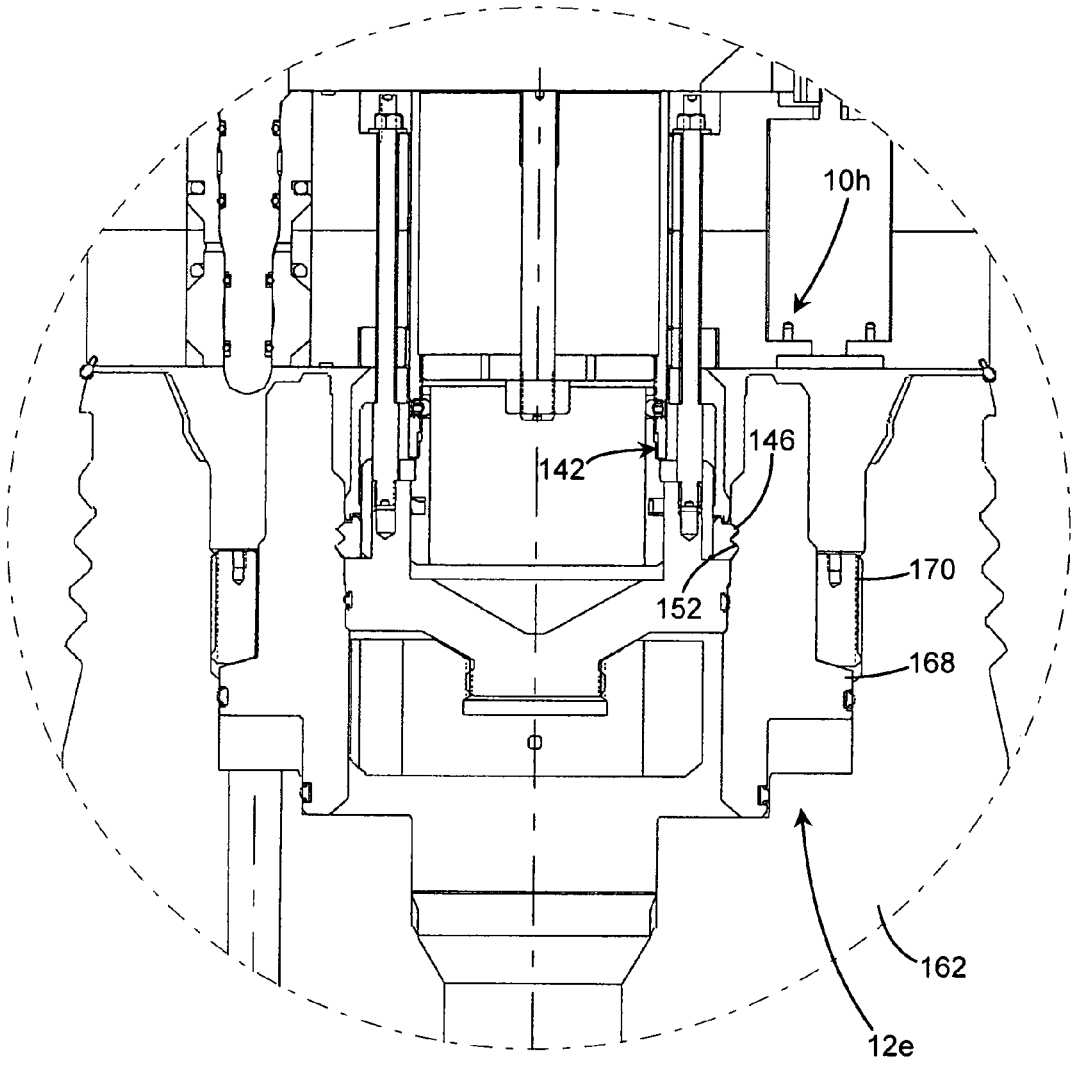
FIG. 15 is an enlarged view of the portion of the completion system of FIG. 14 which is identified by the letter "H".

As shown more clearly in FIG. 15, the tree cap 188 comprises a universal lower connection interface 10*h* which is complementary to the universal upper connection interface 12*e* of the tree 162. The lower connection interface is similar to the lower connection interface 10*b* discussed above in that it comprises an internal lock ring 146 which engages an internal locking profile 152 to thereby secure the tree cap 188 to the tree 162. In this regard, the locking profile 152 is formed on the adapter bushing 168, rather than directly on the inner diameter of the tree 162.

Thus, the universal connection interfaces 10, 12 of the present invention afford a great deal of flexibility and cost savings in the design and installation of subsea completion systems. By providing these interfaces on the top and/or bottom ends of several components of the completion system and the tools which are used to install and test the completion system, the order in which the components are connected and installed can be tailored to the needs of a particular subsea well. In addition, the number of tools which are required to install and test these components can be minimized.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

What is claimed is:

1. A subsea completion system which includes:

a wellhead which is positioned at the upper end of a well bore and comprises a first upper connection interface;

a tree which is positioned above the wellhead and comprises a second upper connection interface;

a lower riser package ("LRP") which is positioned above the tree and comprises a third upper connection interface;

a tubing hanger which is positioned in the wellhead and comprises a fourth upper connection interface;

a blowout preventor ("BOP") which comprises a first lower connection interface that is operatively engageable with the first, second and third upper connection interfaces; and a tubing hanger running tool ("THRT") which comprises a second lower connection interface that is operatively engageable with the second, third and fourth upper connection interfaces;

wherein during a first stage of installation of the subsea completion system the BOP is connected to the wellhead and the THRT is connected to the tubing hanger; and wherein during a second stage of installation of the subsea completion system the tree, with the LRP connected to the top thereof, is connected to the wellhead and both the BOP and the THRT are connected to the LRP.

2. The subsea completion system of claim 1, wherein each of the first through fourth upper connection interfaces comprises a locking profile and each of the first and second lower connection interfaces comprises a lock ring that is engageable with the locking profile.

3. The subsea completion system of claim 1, wherein each of the first, second and third upper connection interfaces comprises an external locking profile and the first lower connection interface comprises an external connector which includes a lock ring that is engageable with the locking profile.

4. The subsea completion system of claim 1, wherein each of the first through fourth upper connection interfaces comprises a first sealing surface, each of the first and second lower connection interfaces comprises a second sealing surface, and the first and second sealing surfaces are engageable by a common seal.

5. The subsea completion system of claim 1, wherein each of the second, third and fourth upper connection interfaces comprises a production bore and the second lower connection interface comprises a production stab which is engageable with the production bore.

6. A method for constructing a subsea completion system which comprises:

installing a wellhead at the upper end of a well bore, the wellhead comprising a first upper connection interface;

providing a tree with a second upper connection interface;

connecting a lower riser package ("LRP") to the top of the tree the LRP comprising a third upper connection interface;

providing a tubing hanger with a fourth upper connection interface;

connecting a blowout preventor ("BOP") to the top of the wellhead, the BOP comprising a first lower connection interface that is operatively engageable with the first, second and third upper connection interfaces;

connecting a tubing hanger running tool ("THRT") to the tubing hanger, the THRT comprising a second lower connection interface that is operatively engageable with the second, third and fourth upper connection interfaces;

landing the tubing hanger in the wellhead through the BOP;

disconnecting the BOP from the wellhead;

connecting the BOP to the top of the LRP, with the LRP connected to the top of the tree; and connecting the tree to the wellhead.

7. The method of claim 6, wherein each of the first through fourth upper connection interfaces is provided with a locking profile and each of the first and second lower connection interfaces is provided with a lock ring that is engageable with the locking profile.

8. The method of claim 6, wherein each of the first, second and third upper connection interfaces is provided with an external locking profile and the first lower connection interface is provided with an external connector which includes a lock ring that is engageable with the locking profile.

9. The method of claim 6, wherein each of the first through fourth upper connection interfaces is provided with a first sealing surface, each of the first and second lower connection interfaces is provided with a second sealing surface, and the first and second sealing surfaces are engageable by a common seal.

10. The method of claim 6, wherein each of the second, third and fourth upper connection interfaces is provided with a production bore and the second lower connection interface is provided with a production stab which is engageable with the production bore.

11. A subsea completion system which includes:

a wellhead which is positioned at the upper end of a well bore and comprises a first upper connection interface;

a tree which is positioned above the wellhead and comprises a second upper connection interface;

a lower riser package ("LRP") which is positioned above the tree and comprises a third upper connection interface;

a tubing hanger which is positioned in the wellhead and comprises a fourth upper connection interface;

a seabed isolation device ("SID") which comprises fifth upper connection interface and a first lower connection interface that is operatively engageable with the first, second and third upper connection interfaces; and a tubing hanger running tool ("THRT") which comprises a second lower connection interface that is operatively engageable with the second, third and fourth upper connection interfaces;

wherein during a first stage of installation of the flow completion system the SID is connected to the wellhead and the THRT is connected to the tubing hanger; and wherein during a second stage of installation of the subsea completion system the tree, with the LRP connected to the top thereof, is connected to the wellhead and both the SID and the THRT are connected to the LRP.

12. The subsea completion system of claim 11, further comprising:

a high pressure riser which comprises a third lower connection interface that is operatively engageable with the first, second, third and fifth upper connection interfaces;

wherein during a third stage of installation of the subsea completion system the high pressure riser is connected to the SID.

13. The subsea completion system of claim 11, further comprising:

an emergency disconnect package ("EDP") which comprises a fourth lower connection interface that is operatively engageable with the first, second, third and fifth upper connection interfaces;

wherein during a fourth stage of installation of the subsea completion system the SID is removed and the EDP is connected to the LRP.

14. The subsea completion system of claim 11, further comprising:

a subsea centerline jumper which comprises a fifth lower connection interface that is operatively engageable with the first, second, third and fifth upper connection interfaces;

wherein during a fifth stage of installation of the subsea completion system the SID and LRP are removed and the jumper is connected to the tree.

* * * * *